United States Patent [19]

Fitzgerald-Smith

[11] 4,411,036

[45] Oct. 25, 1983

[54] TRANSPORTABLE BRIDGE

[75] Inventor: James P. Fitzgerald-Smith, Ossemsley, England

[73] Assignee: The Secretary of State for Defence in Her Britannic Majesty's Government of the United Kingdom of Great Britain and Northern Ireland, London, England

[21] Appl. No.: 321,511

[22] Filed: Nov. 16, 1981

[30] Foreign Application Priority Data

Nov. 27, 1980 [GB] United Kingdom ..... 8038076

[51] Int. Cl.[3] ..... E01D 15/12; E01D 15/14

[52] U.S. Cl. ..... 14/2.4; 14/2.6; 14/27

[58] Field of Search ..... 14/2.4, 27, 2.6, 73, 14/16.5, 71.1, 71.3, 71.7

[56] References Cited

U.S. PATENT DOCUMENTS

| | | | |
|---|---|---|---|
| 2,013,195 | 9/1935 | Ward | 14/16.5 |
| 2,556,175 | 6/1951 | Frost | 14/2.4 |
| 3,747,354 | 7/1973 | Macomber | 14/71.1 X |
| 3,866,771 | 2/1975 | Reid | 14/71.1 X |
| 4,042,991 | 8/1977 | Macy | 14/73 X |

*Primary Examiner*—Nile C. Byers, Jr.

*Attorney, Agent, or Firm*—Pollock, Vande Sande & Priddy

[57] ABSTRACT

A transportable bridge comprises two parallel trackway girders 2 interconnected by articulated decking members 3 which permit the bridge to be contracted in width for transportation upon a launcher vehicle 20. The bridge is loaded in an inverted position upon a launch frame 23 tiltable about the rear of the vehicle, from which frame it may be deployed end-over-end by upward rotation of the frame by jacking means 25, 27 to a vertical position, from where the bridge is further downwardly rotated to a horizontal position by winch means 35 attached to the launch frame.

7 Claims, 3 Drawing Figures

TRANSPORTABLE BRIDGE

Figure 1:
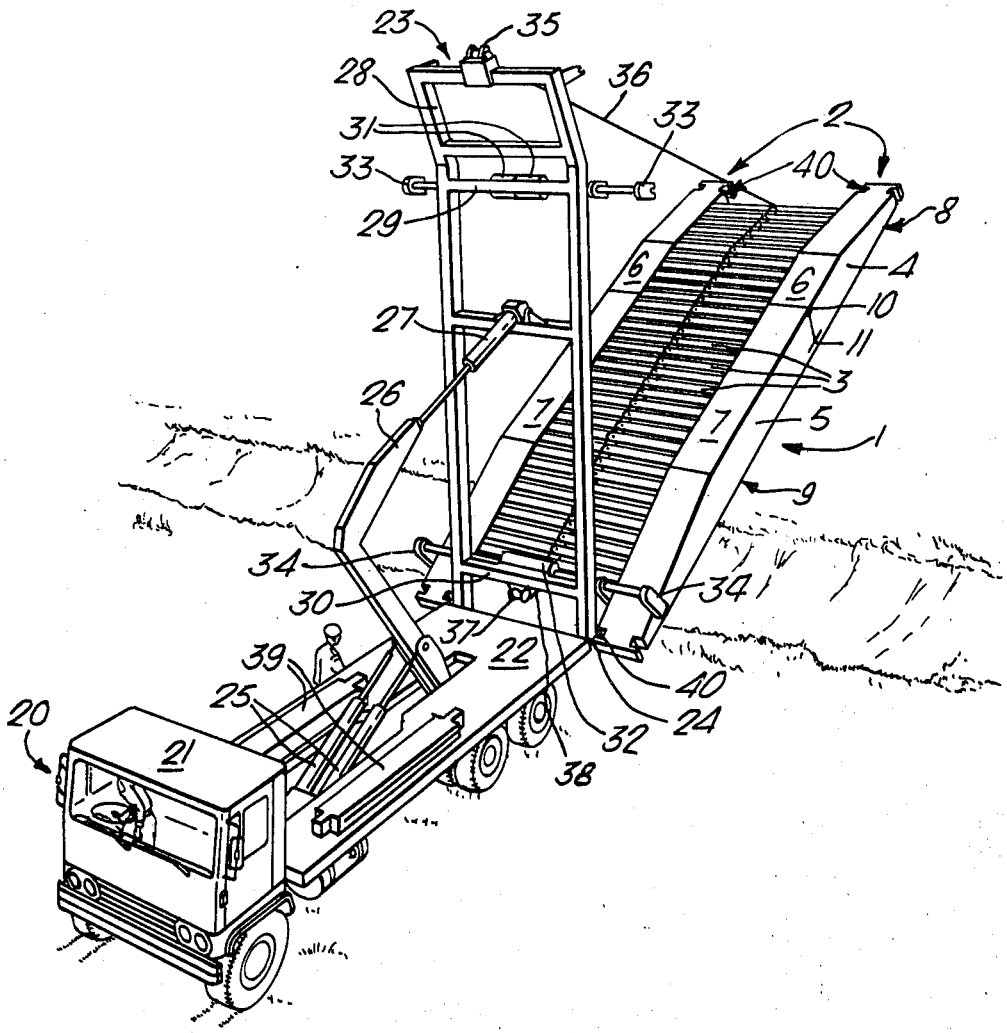

This invention relates to a transportable bridge and to an associated transporter/launcher vehicle.

Many transportable bridges have been designed in which component parts of a bridge are transversely hinged so as to fold together onto a single transporter/-launcher vehicle from which they may be deployed by fully mechanized means. The majority of these designs are extremely cumbersome, often being able to bridge gaps of up to 30 m, and consequently lack maneuverability in transit.

There is a need for a more readily transported and deployed bridge suitable for bridging smaller gaps of up to about 8 m. The present invention seeks to satisfy that need by providing a bridge of contractible width for transportation and a transporter/launcher vehicle from which the bridge may be rotatably launched.

According to the present invention a transportable bridge includes two substantially parallel trackway girders each having a decking face, a ground opposable face, a home bank end and a far bank end, which girders are laterally spaced apart by a multiplicity of articulated decking members each pivotally attached adjacent their two ends to the two girders respectively so as to be foldable in a direction permitting variation of the lateral separation of the two girders.

Conveniently, the articulated decking members may be two-part and foldable in a plane parallel with the decking faces, the members together providing a common surface which is preferably disposed at the level of the decking faces.

For convenience in transit, each girder may be transversely jointed and comprise two girder portions, ie a home bank portion and a far bank portion, pivotally interconnected so as to permit relative rotation of the portions about an axis parallel to the decking face, looking means being provided for securing the portions in longitudinal alignment in deployment.

The invention further includes a transporter/-launcher vehicle having a launch frame for supporting the bridge in transit in an inverted position, ie ground opposable face upwards, which frame is pivotally connected to the vehicle chassis adjacent its rear end, and tiltable about the rear end by jacking means located on the vehicle. Preferably the bridge is carried with its home bank end at the rear of the vehicle and the launch frame includes pivotal engagement means for engaging the home bank girder portions to the frame adjacent the pivotal connection of the frame to the vehicle. The launch frame further includes girder separation adjustment means and winching means operative between the frame and the far bank girder portions for raising and lowering the far bank end of the bridge to and from the frame when the frame has been tilted by the jacking means to a substantially vertical position.

In order to minimize the overall height of the vehicle and bridge when loaded for transit the frame is preferably cranked so as to permit the far bank girder portions to lie flat along the roof of the cab of the vehicle, the relative proportions of the home bank and far bank portions being selected so that the division between them coincides with the crank.

Figure 2:
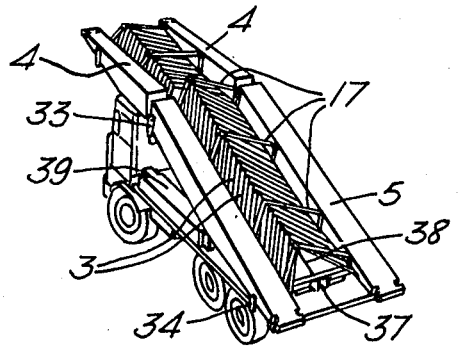
Figure 3:
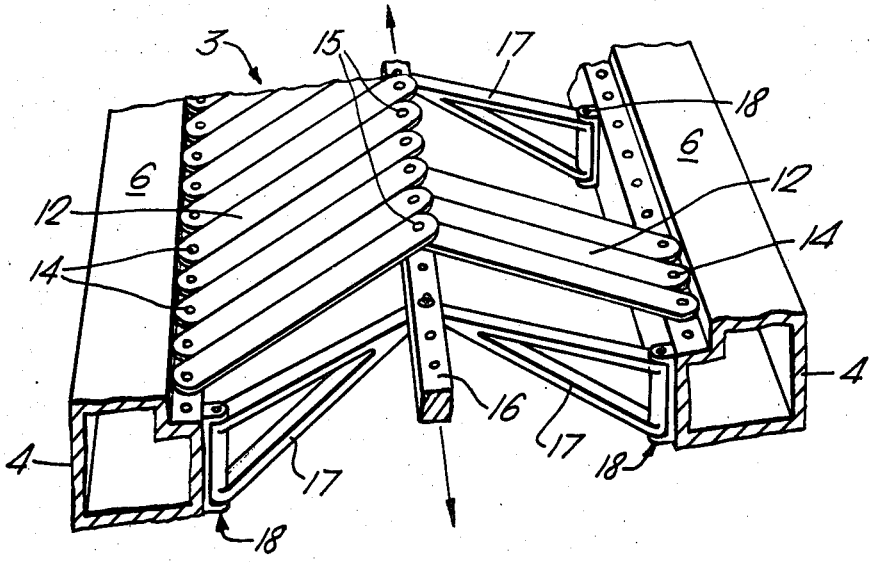

An embodiment of the invention will now be described by way of example only with reference to the accompanying drawings of which FIG. 1 is a perspective view of a fully extended bridge in the course of deployment from a transporter/-launcher, FIG. 2 is a perspective view of the same bridge contracted and loaded upon the transporter/launcher for transit, and FIG. 3 is a detailed view of the articulation system employed in the bridge of FIGS. 1 and 2.

The bridge 1 illustrated in FIGS. 1 and 2 comprises a pair of girders 2 transversely interconnected by a multiplicity of two-part articulated decking members 3. Each girder consists of a far bank portion 4 and a home bank portion 5 respectively having decking faces 6 and 7 and ground opposable faces 8 and 9. The portions 4 and 5 are jointed together at a hinge 10 adjacent the decking faces 6 and 7 and can be locked into line with a fastener 11 engagable adjacent the ground opposable faces 8 and 9.

The articulated decking members 3 (also illustrated in detail in FIG. 3) each comprise a pair of slats 12 rotatably connected at their outer ends to the girder portions 4 (or 5) adjacent the decking faces 6 (or 7) at pivots 14. The inner ends of the slats 12 of each pair are rotatably interconnected at a pivot 15 attached to a longitudinal tie-bar 16, which tie-bar is pivotally supported upon five equally spaced pairs of triangular support frames 17 rotatably attached at their outer edges to the girder portions 4 (or 5) at pivots 18. The tie-bar is transversely divided at the line of the girder hinges 10 so as not to inhibit their opening.

Also illustrated in FIGS. 1 and 2 is a transporter vehicle 20 having a cab 21 and a chassis 22, to the rear end of which chassis a launch frame 23 is hinged at a pivot 24. The frame 23 is rotatable about the pivot 24 by hydraulic jacks 25 via a thrust arm 26 pivotally mounted on the vehicle 20, and by a further hydraulic jack 27 operative between the arm 26 and the frame 23 which permits the frame to be rotated slightly beyond the vertical.

The frame 23 is rectangular with a cranked end 28 which, when the frame is lowered for transit, lies flat along the top of the cab 21. Mounted on cross members 29 and 30 of the frame 23 are two back-to-back pairs of hydraulic jacks 31 and 32 respectively, the pistons of which extend transversely from the frame and support at their outer ends pivotably engageable girder clamps 33 and 34 respectively. Mounted centrally at the cranked end 28 is an electric winch 35 carrying a cable 36 which is attachable to the far bank end of the bridge. A second electric winch 37 is mounted at the other end of the frame 23 and carries a cable 38 attachable to the home bank end of the bridge.

For transit, the bridge 1 is transported upon the frame 23 in an inverted position, the girder portions 5 being secured at their decking faces within the respective girder clamps 33 and 34 and the girder portions 4 being located so as to lie upon the cranked end 28 of the frame when the fastener 11 is released.

Upon arrival at a bridging site the girder portions 4 and 5 are aligned by closing the hinge 10 and securing the fastener 11. The vehicle is then backed up to the gap and the girder separation of the bridge is extended to full width by means of the jacks 31 and 32. The bridge is locked into this configuration by means of end beams 39 (illustrated for convenience still in their transit position on the vehicle chassis 22) which are inserted into pockets 40 opposably located in the girder portions 4 and 5.

The girder clamps 33 are then opened and the frame 23 is tilted up to the near vertical by means of the jacks 25 and then brought to a position at which the weight of the bridge is slightly over top dead center by means of the jack 27. The far bank end of the bridge is then lowered across the gap by means of the winch 35 and the cable 36, the home bank end of the bridge pivoting in the girder clamps 34. As the bridge approaches the horizontal and the far bank end becomes emplaced, the home bank end automatically disengages from the girder clamps 34 and is then lowered to the ground by means of the winch 37 and the cable 38. The two winch cables 36 and 38 are then disengaged from the bridge, end ramps (not shown) fitted to the end beams 39, and the launch frame 23 and vehicle 20 removed, leaving the bridge ready for use.

The bridge is retrieved after use by reversing the above launching sequence.

A specific example of the bridge 1 having a girder length of 9 m, an extended width of 4 m, a contracted width of 2.3 m and a weight of approximately 4 tons can be carried on a vehicle 20 of 13 tonnes. A known 13 tonne tilt-frame truck, Ampliroll (registered trade mark), may be readily adapted for this purpose by the addition of an appropriate launch frame 23 and jack 27, the jacks 25 and the thrust arm 26 being already available as a standard item on the truck.

In its transit configuration this specific example has a bridge width no greater than that of the vehicle itself and has an overall height of less than 4 m, thereby offering no problems in maneuvering through narrow lanes or built up areas. The bridge can be launched by two men in about five minutes and recovered in approximately the same time without the use of any ancillary equipment. The men require no specialist training in bridging techniques.

It will be apparent that various other embodiments in accordance with the invention are possible. For example, the articulated decking members may be of varying degrees of complexity, possibly operating on a "lazy tong" or shutter principle to provide a lattice-work deck.

I claim:

1. A transportable bridge including two substantially parallel trackway girders each having a decking face, a ground opposable face, a home bank end and a far bank end; said girders being laterally spaced apart by a multiplicity of articulated decking members each pivotally attached adjacent its two ends to the two girders respectively so as to be foldable in the plane of the decking faces thereby to permit variation of the lateral separation of the two girders, each of said articulated decking members comprising two-part members which are conjointly rotatably attached at a central pivot to a tie-bar located intermediate and parallel with the girders, each pivot being attached in sequence to the tie-bar; a plurality of foldable decking support frames attached to each girder, each frame having one end hinged to the respective girder and another end rotatably attached to the tie-bar; and a pair of end beams lockable between the two girders at the far bank end and the home bank end respectively when the articulated decking members and the support frames are fully extended.

2. A transportable bridge as claimed in claim 1 further comprising a transporter/launcher vehicle having a cab and a chassis and including: a launch frame having a hinged end connection to the rear end of the chassis; jacking means for tilting the launch frame upwards from the chassis about the hinged end connection to a substantially vertical position; pivotal engagement means attached to the launch frame adjacent the hinged end connection engageable with the home bank ends of both girders when the bridge is located for transit upon the launch frame in an inverted position; adjustment means attached to the launch frame for varying the lateral separation of the two girders; and far bank end winching means operative between the launch frame and the far ends of the two girders for raising and lowering the bridge about the pivotal engagement means when the launch frame has been tilted to the substantially vertical position by the jacking means.

3. A transportable bridge and transporter/launcher vehicle as claimed in claim 2 wherein the jacking means comprises: a thrust arm pivotally attached at its basal end to the chassis; at least one hydraulic jack operative between the chassis and the thrust arm so as to rotate it upwards from the chassis; and a further hydraulic jack operative between the distal end of the thrust arm and the launch frame.

4. A transportable bridge and transporter/launcher vehicle as claimed in claim 2 further including home bank end winching means attached to the launch frame adjacent the pivotal engagement means for raising and lowering the home bank ends of the two girders to and from the pivotal engagement means.

5. A transportable bridge and transporter/launcher vehicle as claimed in claim 2 wherein the launch frame is of greater length than the chassis and is cranked so as to extend forward over the cab in a substantially horizontal plane.

6. A transportable bridge including two substantially parallel trackway girders each having a decking face, a ground opposable face, a home bank end and a far bank end; said girders being leterally spaced apart by a multiplicity of articulated decking members each pivotally attached adjacent its two ends to the two girders respectively so as to be foldable in a direction permitting variation of the lateral separation of the two girders; said transportable bridge further comprising a transporter/launcher vehicle having a cab and a chassis, said vehicle including a launch frame having a hinged end connection to the rear end of the chassis, jacking means for tilting the launch frame upwards from the chassis about the hinged end connection to a substantially vertical position, pivotal engagement means attached to the launch frame adjacent the hinged end connection engageable with the home bank ends of both girders when the bridge is located for transit upon the launch frame in an inverted position, adjustment means attached to the launch frame for varying the lateral separation of the two girders, said adjustment means comprising at least one pair of opposed hydraulic jacks attached to the launch frame and respectively operative upon the two girders, and far bank end winching means operative between the launch frame and the far bank ends of the two girders for raising and lowering the bridge about the pivotal engagement means when the launch frame has been tilted to the substantially vertical position by the jacking means.

7. A transportable bridge including two substantially parallel trackway girders each having a decking face, a ground opposable face, a home bank end and a far bank end; said girders being laterally spaced apart by a multiplicity of articulated decking members each pivotally attached adjacent its two ends to the two girders respectively so as to be foldable in a direction permitting variation of the lateral separation of the two girders; said transportable bridge further comprising a transporter/launcher vehicle having a cab and a chassis and including a launch frame having a hinged end connection to the rear end of the chassis, said launch frame being of greater length than the chassis and being cranked so as to extend forward over the cab in a substantially horizontal plane, jacking means for tilting the launch frame upwards from the chassis about the hinged end connection to a substantially vertical position, pivotal engagement means attached to the launch frame adjacent the hinged end connection engageable with the home bank ends of both girders when the bridge is located for transit upon the launch frame in an inverted position, adjustment means attached to the launch frame for varying the lateral separation of the two girders, and far bank end winching means operative between the launch frame and the far bank ends of the two girders for raising and lowering the bridge about the pivotal engagement means when the launch frame has been tilted to the substantially vertical position by the jacking means; said bridge being transversely jointed at a location permitting conformability with the cranked launching frame when mounted for transit, each trackway girder being divided into two portions, a home bank portion and a far bank portion, pivotally interconnected at an axis perpendicular to the girders and lying in the plane of the decking faces, and locking means for securing the two portions of each girder in longitudinal alignment for deployment.

* * * * *